US007306032B2

(12) United States Patent
Paton

(10) Patent No.: US 7,306,032 B2
(45) Date of Patent: Dec. 11, 2007

(54) FLUID COLLECTING DEVICE

(75) Inventor: Alan Stewart Paton, Aberdeen (GB)

(73) Assignee: Sub-Drill Supply, Limited (GB)

( * ) Notice: Subject to any disclaimer, the term of this patent is extended or adjusted under 35 U.S.C. 154(b) by 137 days.

(21) Appl. No.: 10/483,940

(22) PCT Filed: Nov. 20, 2003

(86) PCT No.: PCT/GB03/05060

§ 371 (c)(1),
(2), (4) Date: Jan. 14, 2004

(87) PCT Pub. No.: WO2004/048746

PCT Pub. Date: Jun. 10, 2004

(65) Prior Publication Data

US 2005/0155757 A1 Jul. 21, 2005

(30) Foreign Application Priority Data

Nov. 22, 2002 (GB) ..... 0227281.3

(51) Int. Cl.
*E21B 19/00* (2006.01)

(52) U.S. Cl. ..... 166/81.1; 175/207; 175/214

(58) Field of Classification Search ..... 166/81.1, 166/84.1, 84.4, 93.4, 4.1; 175/207, 214; 294/88, 103.1
See application file for complete search history.

(56) References Cited

U.S. PATENT DOCUMENTS

| | | | | |
|---|---|---|---|---|
| 2,505,282 | A | 4/1950 | Endsley | |
| 2,522,444 | A | 9/1950 | Grable | |
| 4,023,449 | A * | 5/1977 | Boyadjieff | 81/57.16 |
| 4,573,858 | A * | 3/1986 | Sinclair | 414/620 |
| 4,643,259 | A | 2/1987 | Zeringue, Jr. | |
| 5,295,536 | A | 3/1994 | Bode | |
| 2004/0049905 | A1 | 3/2004 | Jansch et al. | |

FOREIGN PATENT DOCUMENTS

| | | |
|---|---|---|
| GB | 2300659 | 11/1996 |
| WO | WO 00/23686 A1 | 10/1998 |
| WO | WO 01/49968 A1 | 12/1999 |

* cited by examiner

*Primary Examiner*—David Bagnell
*Assistant Examiner*—Nicole Coy
(74) *Attorney, Agent, or Firm*—Gary L. Bush; Brett T. Cooke; Andrews Kurth LLP

(57) ABSTRACT

An adjustable fluid collecting device with two shells pivotally movable relative to each other wherein the fluid collecting device is movable between an open position in which the shells are distanced from each other and a closed position in which the shells touch, an actuator and a lever assembly wherein the operation of the actuator results in equal but opposite movement of the shells and the mechanical advantage increases as the shells move toward the closed position. A rigid frame which substantially surrounds the two shells, actuator and lever assembly is provided. Optionally, the apparatus can be equipped with an integral pipe spinner.

27 Claims, 3 Drawing Sheets

FLUID COLLECTING DEVICE

BACKGROUND OF THE INVENTION

1. Field of the Invention

The invention relates generally to a fluid collecting device for use when disconnecting pipes and in particular to a mud bucket for use in the oil production industry.

As is well known, borehole drilling is generally carried out by means of a drill bit at the end of a string of hollow sections of pipe which are joined by tapered threaded connections. The connections are sufficiently strong to transmit the linear, torsional and bending forces involved in drilling and also provide a mechanical seal to prevent leakage of the drilling mud which is pumped down the drill string to lubricate the bit, balance hydrostatic pressure in the rock formation, and carry the cuttings back to the surface.

Drilling mud can contain a variety of chemicals, and for cost, environmental and safety reasons it is desirable that spillage of mud in the drilling rig should be kept to a minimum. Drill pipes are generally connected together in approximately 27-meter long "stands" consisting of three 9-meter lengths. Depending on its internal diameter, each stand can contain a considerable amount of mud. For example, the internal volume of 27 meters of pipe with a mean internal diameter of 63.5 mm is 85.5 liters.

When withdrawing the drill string from a hole, a large proportion of the mud can remain in the drill pipes and would escape when each stand was disconnected unless measures where taken to prevent this from happening. A device commonly used to contain leakage is referred to as a mud bucket and basically consists of shells which are clamped around the drill pipe connection when it has been sufficiently loosened that further rotation requires relatively little torque, but significant leakage has not occurred. A hose is led from the mud bucket to a holding tank to enable the mud collected in the mud bucket to be returned to the holding tank. A mud bucket can be deployed either by suspension from a wire connected to a hoist, or can be automatically moved into position by mechanical arms and other robotic devices.

The shells of a mud bucket are fitted with elastomeric seals to provide a leakage-free fit at the joints with each other and the drill pipe. The shells of the mud bucket may be clamped or closed around the drill pipe manually or by hydraulic or pneumatic actuators. Regardless of the clamping method employed, the shell closing mechanism must be capable of resisting the large force resulting from the pressure exerted by the mud column on the shells. Each meter of mud in the column equates to a pressure of about 0.1 bar when the specific gravity is 1.0. The force on each half of the shell is equal to the projected area multiplied by the total pressure. For example, if the internal diameter of the shells is 300 mm, the height 1.5 meters and the mud column 10 meters, the force on the shells is about 44,000 newtons or 4.4 metric tons.

2. Description of the Prior Art

GB 2300659 describes a mud bucket comprising a can which is longitudinally split into two sections. Each section is provided with a seal along the split, and the two sections are hinged together at a common pivot point. Each section is further connected to an actuator which moves the mud bucket between an open and closed position.

However, in the mud bucket described in GB 23003659, the perpendicular distance between the actuator and the common pivot point between the two sections decreases as the device closes, so that the leverage available to the actuator to close the mud bucket is decreased in the very time at which it is desirable for it to be increased. This means that larger actuators have to be used, or some subsidiary mechanical or hydraulic locking mechanism employed to prevent leakage caused by the internal mud pressure.

All drill pipes are joined together using male and female threads cut into larger diameter sections (or tool joints) at each end. The threads are then tightened up to a very high torque to withstand the linear, torsional and bending forces involved in drilling.

When drill pipe is removed from the bore hole, it is customary to loosen the high torque of the tool joints with two tongs, which can be either manually or hydraulically operated, so that further rotation requires relatively little torque. At this stage little or no mud is leaking from the tool joints, and the mud bucket is clamped around the drill pipe tool joints. Once the mud bucket is installed, a separate hydraulic or pneumatic pipe spinner (or spinning wrench) is used to revolve the upper pipe stand for a number of full turns, and therefore complete the loosening of threads of the tool joints. The spinner rotates the upper drill pipe stand by means of motor driven rollers or chains, while the lower drill pipe is prevented from rotating by the tapered slips used to hold it in position. The upper stand in than lifted up a few centimeters to allow the drilling mud to drain into the mud bucket and through the drain hose to a holding tank.

On manual drilling rigs the pipe spinner is swung into location on the pipe above the mud bucket on a hanging wire attached to a winch by personnel who often have to climb onto the mud bucket to complete the operation. This can be dangerous for personnel if the mud bucket is positioned at an awkward height above the drill floor.

On automatic and semi-automatic drilling rigs it is customary to use a hydraulically powered and positioned device called an iron roughneck that employs a pair of tongs and a pipe spinner, one of whose functions is to provide the loosening and spinning functions described above. Newer models of this device are fitted with an integral mud bucket that can be clamped around the tool joints prior to the final loosening of the tool joints with the device's integral pipe spinner. Older models of this device are not fitted with a mud bucket, and it is not possible for a separate mud bucket to be deployed during the spinning function. This results in significant mud loss onto the drill floor before the separate mud bucket can be deployed.

U.S. Pat. No. 4,643,259 describes a hydraulic drill string breakdown and bleed-off unit which includes a hydraulic drill string disassembly apparatus in combination with a pressure chamber for bleeding off trapped pressure in the drill pipes and a further apparatus for collecting drilling mud from the drill pipes. The unit described in U.S. Pat. No. 4,643,259 employs two tongs for loosening the torque of the tool joints of the drill pipes and is large, heavy, slow, cumbersome and expensive to manufacture.

3. Identification of Objects of the Invention

An object of the invention is to overcome the problems of the prior art by providing a fluid collecting device designed and arranged such that the mechanical advantage of the closing actuator increases as the bucket moves from an open to a closed position.

Another object of the invention is to provide a fluid collection device having an actuator attached to a rigid frame.

Another object of the invention is to provide a fluid collection device housed within a supporting framework to provide operator safety.

Another object of the invention is to provide a fluid collection device in combination with a pipe spinner, housed within a common framework.

SUMMARY OF THE INVENTION

According to the invention there is provided an adjustable fluid collecting device comprising two shells pivotally movable relative to each other wherein the fluid collecting device is movable between an open position in which the shells are distanced from each other and a closed position in which the shells touch and the angle between the lever member and the link member is reduced relative to the angle between the same members when the adjustable fluid collecting device is in its open position.

Preferably, the adjustable fluid collecting device includes two shells pivotally movable relative to each other and a lever member operated by an actuator. The lever member is pivotally connected to a link member which is pivotally connected to at least one of the shells. The lever member is pivotally movable relative to at least one of the shells.

In a second aspect of the invention, an adjustable fluid collecting device includes two shells pivotally movable relative to each other and a lever member operated by an actuator. The lever member is pivotally connected to first and second linking members. The first linking member is pivotally connected to one of the shells. The second linking member is pivotally connected to the other shell so that operation of the actuator results in equal but opposite movement of the shells.

Preferably, the actuator is attached to a rigid frame which substantially surrounds the two shells, actuator and lever assembly. The rigid frame includes bracketing members to which the two shells are pivotally mounted.

Desirably, the second linking member is pivotally connected to the second shell by way of a third linking member, and the second linking member is further pivotally connected to the bracketing member by way of a fourth linking member.

Preferably, the lever member is also pivotably connectable to the bracketing member. Desirably, the lever member is a bellcrank.

Preferably, the adjustable fluid collecting device is used for collecting mud during the disconnection of pipes.

In a third aspect of the invention, a fluid collecting device includes a mud bucket housed within a supporting framework.

In a fourth aspect of the invention, a pipe disconnecting assembly arranged and designed to engage with a plurality of connected pipes includes a rotating means and a fluid collecting device, housed within a single framework, wherein the fluid collecting device is clampable to the connected pipes so that it surrounds the junction therebetween and the rotating means is movable to engage with at least one of the connected pipes so that rotation of the rotating means causes the disconnection of at least one connected pipes, and the fluid collecting device collects any fluid which leaks out of the opened junction between the pipes.

BRIEF DESCRIPTION OF THE DRAWINGS

Three embodiments of the invention will now be discussed by way of example only with reference to the accompanying drawings in which.

DESCRIPTION OF PREFERRED EMBODIMENTS

Figure 1:
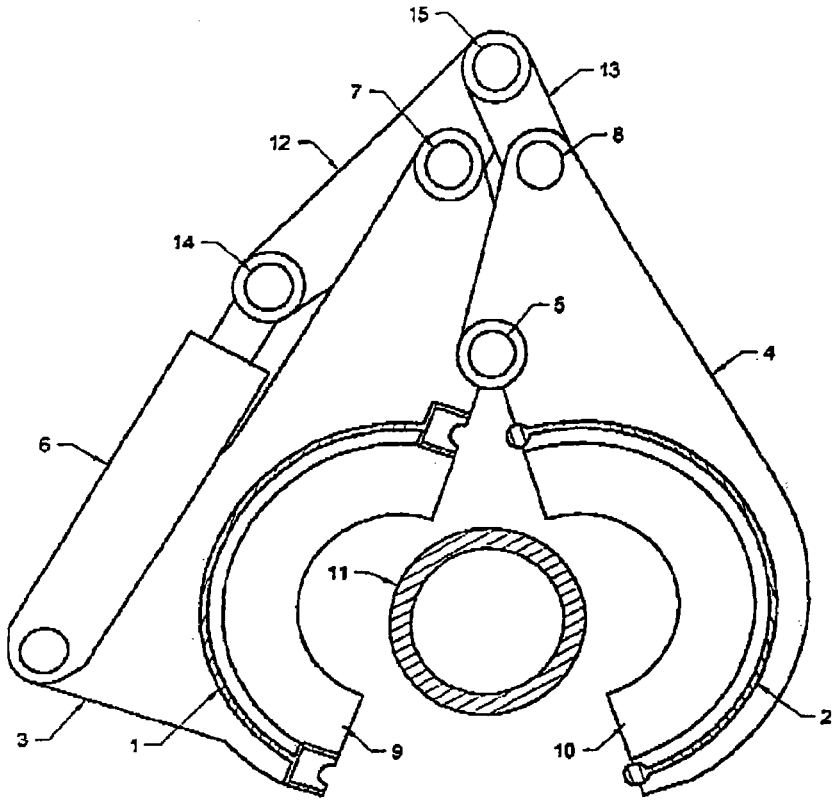
FIG. 1 is a top view partially in cross-section of a first embodiment of the adjustable fluid collecting device in an open position around a drill pipe.

Turning to FIG. 1, a first embodiment of the invention includes two shells 1 and 2 with bottom halves 9, 10 attached respectively thereto and with the shells fitted with arms 3 and 4 which are hinged at a common pivot point 5. An actuator 6 operates a bellcrank 12 through a pin 14. The bellcrank 12 is pivoted at pin 7 on arm 3. The bellcrank 12 is further connected to a linking member 13 by a pin 15. The linking member 13 is connected to arm 4 via pin 8.

Figure 2:
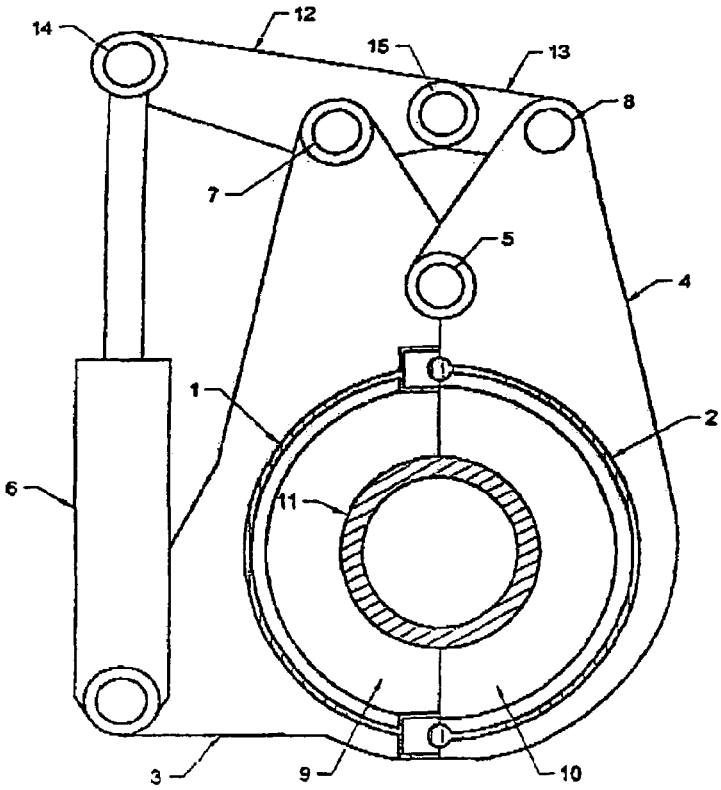
FIG. 2 is a top view partially in cross-section of the first embodiment shown in FIG. 1 in a closed position around a drill pipe.

Turning to FIG. 2, when the first embodiment is employed in a closed position around a drill pipe, the angle between the bellcrank 12 and the linking member 13 is significantly less than when the first embodiment is in the open position. Since the force available to close the adjustable fluid collecting device varies inversely with the tangent of half the angle between the bellcrank 12 and the linking member 13, a large closing force can be generated by a relatively low powered actuator. For example, if the angle between the bellcrank 12 and the linking member 13 is 10 degrees, the force on the pins 7 and 8 is 0.5/tan5=5.72 times the force on the pin 15 created by the actuator 6. This force can be further increased by making the distance between the pins 14 and 7 greater than the distance between pins 7 and 15 and by increasing the distance between the pins 7 and 8 and the pivot point 5. The velocity ratio between the actuator 6 and the shells 1 and 2 can be adjusted so that the closing mechanism is irreversible. In such case, the shells 1 and 2 are locked into their closed position without the use of any subsidiary mechanism.

Figure 3:
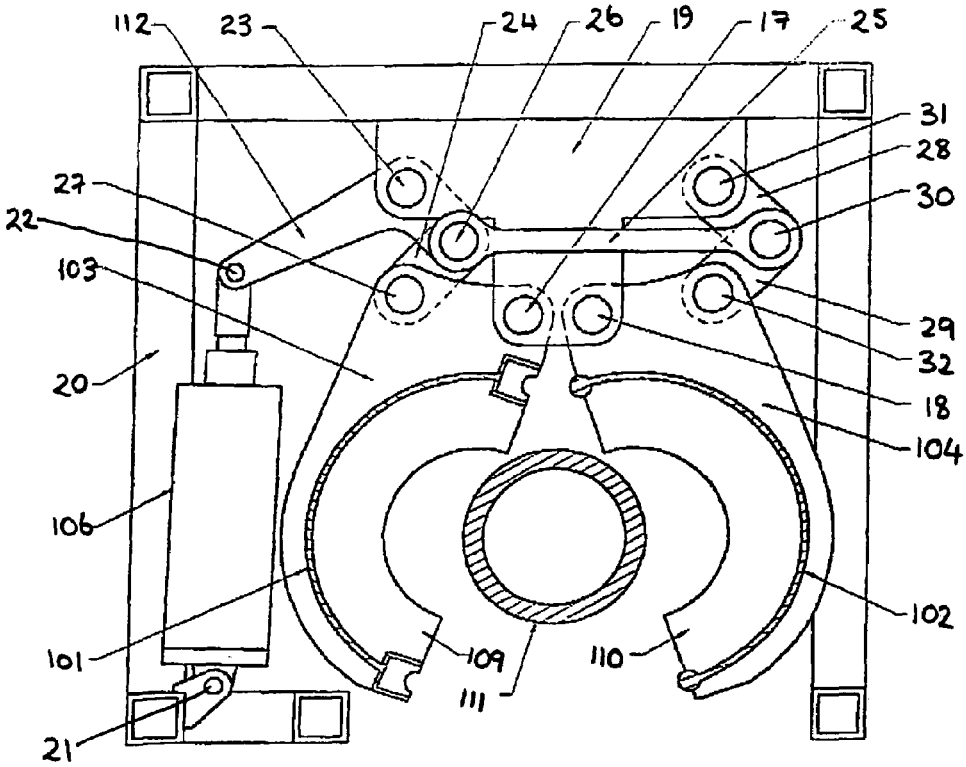
FIG. 3 is a top view partially in cross-section of a second embodiment of the invention in an open position around a drill pipe.

A second embodiment of the adjustable fluid collecting device is illustrated in FIG. 3. Shells 101 and 102 with bottom halves 9, 10 are fitted with arms 103 and 104 and pivoted on pins 17 and 18 mounted on a bracket 19. An actuator 106 is attached to a rigid frame 20 by a pin 21 and operates a bellcrank 112 via a pin 22. The bellcrank 112 is attached to bracket 19 by a pin 23, and to linking members 24 and 25 by a pin 26. The other end of linking member 24 is attached to the arm 103 by a pin 27. Linking member 25 is connected to linking members 28 and 29 by pin 30. The other end of linking member 28 is attached to bracket 19 by pin 31. The other end of linking member 29 is attached to arm 104 by pin 32. Linking members 24, 28 and 29 are arranged in length such that movement of the bellcrank 112 results in equal but opposite movement of the shells 101 and 102.

Figure 4:
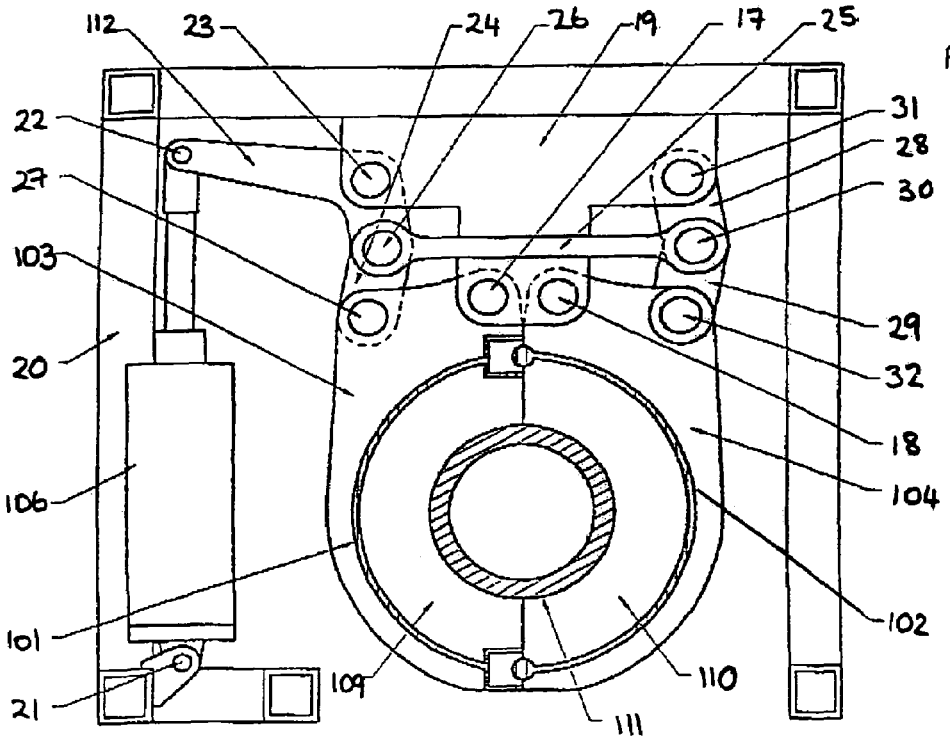
FIG. 4 is a top view partially in cross-section of the second embodiment shown in FIG. 3 in a closed position around a drill pipe.

As illustrated in FIG. 4, the second embodiment employs the same principal as that employed by the first embodiment: increasing the closing force on the shells 101 and 102 by reducing the angle between the actuator 106 and the bellcrank 112 and the linking members. In addition to providing an appropriate mounting of the bracket 19 and the actuator 106, the rigid frame 20 and upper and lower pipe guides (not shown) provide protection for the shells and closing mechanism, provide a safety barrier to protect operators from injury, and facilitates the mounting of the adjustable fluid collecting device on robot arms or other devices providing automatic or semi-automatic operation.

In general terms, the first and second embodiments employ an operating linkage for a mud bucket having a mechanical advantage that increases as the shells close, thereby providing an energy efficient means of closing a mud bucket which does not require the use of large actuators or subsidiary locking mechanisms to prevent drilling-mud leakage.

Figure 5:
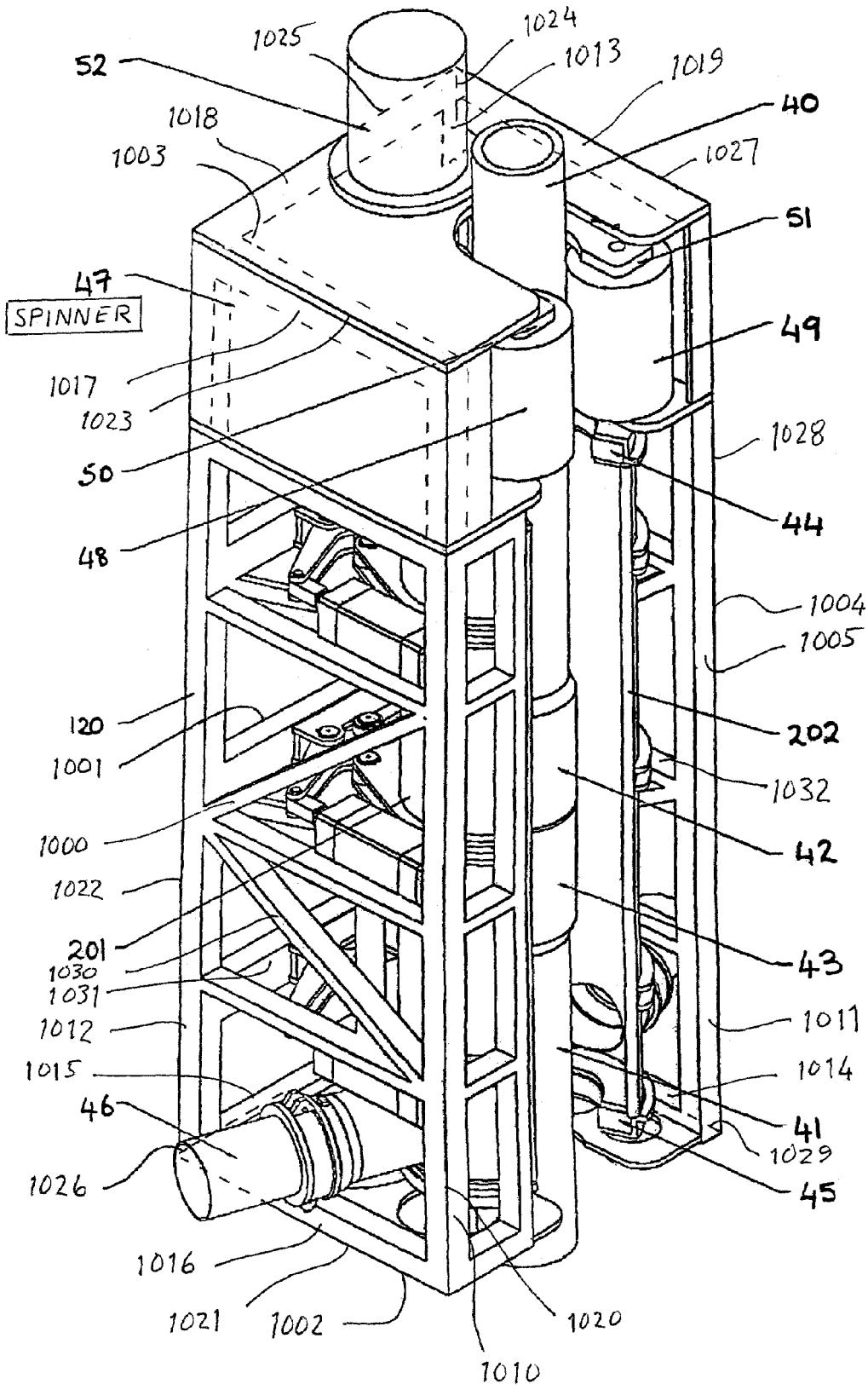
FIG. 5 is a perspective view of a pipe disconnecting assembly in accordance with a third embodiment of the invention surrounding an assembly of connecting pipes.

FIG. 5 shows a third embodiment of the invention in which an upper drill pipe 40 is connected to a lower drill pipe 41 by connections 42 and 43. A pipe disconnecting assembly comprises a frame 120 supporting shells 201 and 202 of either the first or second embodiments of the adjustable fluid collecting device wherein the shells 201 and 202 are fitted with compliant gaskets 44 and 45. The shells in FIG. 5 are shown in the open configuration. After the adjustable fluid collecting device has been positioned, hydraulic or pneumatic actuators are used to close the shells 201 and 202 to create a sealed cylindrical container, surrounding the junction between the upper drill pipe 40 and the lower drill pipe 41. The shells 201 and 202 are further provided with connections 46 for hoses to drain any collected mud to a holding tank.

The frame 120 also supports a housing 47 in which there are rollers 48 and 49 mounted on arms 50 and 51. The arms are duplicated at each end of the rollers, and there are two rollers per arm. The resulting four rollers 48 and 49 can be forced against the upper drill pipe 40 by hydraulic or pneumatic actuators acting on the arms 50 and 51. The rollers are also geared together so that they can be rotated in the same direction by a hydraulic or pneumatic rotary activator 52. The upper drill pipe 40 may thus be rotated by the rollers to disconnect the threads completely. The upper drill pipe is then lifted to allow the mud to escape into the sealed cylindrical contained formed by the closed shells 201, 202. After draining via connection 46, the shells 201 and 202 can then be opened and the whole assembly comprising a mud bucket and spinner withdrawn, ready for the next cycle of operation.

In general, the third embodiment of the invention uses a rigid frame 120 to support a mud bucket and facilitate the accurate operation of the mud bucket relative to the frame, thereby making it easier to deploy the mud bucket automatically by a remote linkage so that the mud bucket is safer to install. As shown in FIG. 5, frame members 1010, 1011, 1012, 1013, 1014, 1015, 1016, 1017, 1018, 1019, 1030, 1031, and 1032, among others, are preferably connected together to form frame 120. Frame 120 preferably includes closed vertical sides 1000, 1001, 1004, open vertical side 1005, top 1003, and bottom 1004. Frame side 1000 has the shape of a closed polygon with edges 1020, 1021, 1022, and 1023 defined by frame members 1010, 1016, 1012, 1017, respectively. Frame side 1001 has the shape of a closed polygon with edges 1022, 1026, 1024, and 1025 defined by frame members 1012, 1015, 1013, and 1018, respectively. Likewise, frame side 1004 has the shape of a closed polygon with edges 1024, 1027, 1028, and 1029 defined by frame members 1018, 1019, 1011, and 1014, respectively. Frame sides 1000, 1001, and 1004 include cross frame members 1030, 1031, and 1032, respectively.

The third embodiment of the invention also improves the safety of the operation of a mud bucket by ensuring that the operation of the device is enclosed within the rigid frame, thereby physically protecting operators from the mud bucket. To this end, the rigid frame may also be provided with suitable guarding to enhance safety. Furthermore, the frame can serve as a means of mounting a joint for a spinner.

A fourth embodiment of the invention combines a pipe spinner with the adjustable fluid collecting device of either the first or second embodiments of the invention, housed within a common mounting suitably adapted to withstand the forces involved in the operation of the pipe spinner and adjustable fluid collecting device. The pipe spinner and adjustable fluid collecting device are movable within the housing to the drill pipe either by suspension from a wire connecting to a hoist, or are automatically moveable within the housing to the drill pipe by mechanical arms or other robotic devices. The resulting assembly minimizes mud-loss, speeds up drilling operations, and greatly improves the safety of personnel on manual rigs and rigs with older models of iron rough neck that do not have an integral pipe spinner.

The invention is not limited by the embodiments hereinbefore described but only by the claims presented below.

What is claimed is:

1. An apparatus for collecting fluid from a drill string comprising, a plurality of frame members (1010, 1011, 1012, 1013, 1014, 1015, 1016, 1017, 1018, 1019, 1030, 1031, 1032) connected to form a rigid frame (120) defining generally planar vertically-oriented first and second sides (1000, 1001), said first side (1000) of said frame formed by connecting together a first set (1010, 1016, 1012, 1017) of said plurality of frame members into a first shape of a closed polygon (1020, 1021, 1022, 1023), said second side (1001) of said frame formed by connecting together a second set (1012, 1015, 1013, and 1018) of said plurality of frame members into a second shape of a closed polygon (1022, 1026, 1024, 1025), first and second shells, said first shell designed and arranged to be moved from an open position to a closed position with the first and second shells sealingly mating with each other around the circumference of a pipe of a predetermined diameter, said first and second shells coupled to said frame, the range of motion of said first and second shells limited by said frame, and an actuator assembly coupled to said first shell and said second shell and designed and arranged to move said first shell and said second shell from said open position to said closed position, said actuator assembly characterized by a mechanical advantage which increases as said first shell and said second shell approach said closed position.

2. The apparatus of claim 1 wherein, said actuator assembly includes an actuator (6) pivotably coupled to said first (1) and second (2) shells.

3. The apparatus of claim 2 wherein, a bellcrank (12) is coupled between said actuator (6) and said first shell (1).

4. The apparatus of claim 3 wherein, said bellcrank (12) has a fulcrum pivotably coupled to said first shell (1) with a first end of the bellcrank (12) coupled to said second shell (2) and a second end of the bellcrank (12) coupled to said actuator (6).

5. The apparatus of claim 4 further comprising, a linkage (13) having a first end pivotably coupled to said first end of said bellcrank (12) and a second end pivotably coupled to said second shell (2).

6. The apparatus of claim 5 wherein, said actuator (106) has a first end pivotably coupled to said frame (20) and a second end, and said bellcrank (112) has a fulcrum pivotably coupled to said frame (20), with a first end of the bellcrank (112) coupled to said first shell and second shells (101, 102) and a second end of said bellcrank (112) is coupled to said second end of said actuator (106).

7. The apparatus of claim 6 further comprising, a tie rod (25) having a first tie rod end pivotably coupled to said first shell (101) and a second tie rod end coupled to said second shell (102), said first end of said tie rod (25) coupled to said first end of said bell crank (112).

8. The apparatus of claim 7 further comprising, a first lever (24) having first and second ends, said first end of said first lever (24) pivotably coupled to said first shell (101), said second end of said first lever (24) pivotably coupled to said first end of said tie rod (25) and said first end of said bellcrank (112), a second lever (29) having first and second ends, said first end of said second lever (29) pivotably coupled to said second shell (102), said second end of said second lever (29) pivotably coupled to said second end of said tie rod (25), and a third lever (28) having first and second ends, said first end of said third lever (28) pivotably coupled to said frame (20), said second end of said third lever (28) pivotably coupled to said second end of said tie rod (25) and said second end of said second lever (29).

9. The apparatus of claim 5 further comprising, a pipe spinner moveably coupled to said frame (20).

10. The apparatus of claim 1 wherein, bottom half members (9, 10) are attached to said first and second shells.

11. The actuator of claim 1 wherein, said actuator assembly includes an actuator (106) with a bellcrank (112) coupled between said actuator (106) and said first shell (101) and pivotal coupling to said second shell (102) and designed and arranged to move said first and second shells from said open position to said closed position and vice versa.

12. The apparatus of claim 11 wherein, said actuator (106) includes a cylinder and an actuator rod with said cylinder pivotably coupled to said frame (20), and said bellcrank (112) has a fulcrum pivotably coupled to said frame (20) with a first end of the bellcrank (112) coupled to said first shell and second shell (101, 102) and a second end of said bellcrank (112) coupled to said actuator rod.

13. The apparatus of claim 12 further comprising, a tie rod (25) having a first tie rod end (25) pivotably coupled to said first shell (101) and a second tie rod end (25) coupled to said second shell (102), said first tie rod end (25) coupled to said first end of said bell crank (112).

14. The apparatus of claim 13 further comprising, a first lever (24) having first and second ends, said first end of said first lever (24) pivotably coupled to said first shell (101), said second end of said first lever (24) pivotably coupled to said first end of said tie rod (25) and said first end of said bellcrank (112), a second lever (29) having first and second ends, said first end of said second lever (29) pivotably coupled to said second shell (102), said second end of said second lever (29) pivotably coupled to said second end of said tie rod (25), and a third lever (28) having first and second ends, said first end of said third lever (28) pivotably coupled to said frame (20), said second end of said third lever (28) pivotably coupled to said second end of said tie rod (25) and said second end of said second lever (29).

15. The apparatus of claim 11 wherein, bottom half members (109, 110) are respectively attached to said first and second shells (101, 102), and compliant gaskets are coupled to said first and second shells (101, 102) such that in said closed position, said compliant gaskets are sealingly disposed between said first and second shells (101, 102).

16. The apparatus of claim 11 wherein, said first and second shells (101, 102) are semi-cylindrically shaped and have longitudinal axes disposed parallel to a longitudinal axis of said pipe (111).

17. The apparatus of claim 1 wherein, each of said first and second sides (1000, 1001) of said frame extends vertically upward from a first horizontal datum plane at a first vertical distance below said first shell to a second horizontal datum plane disposed at a second vertical distance above said first shell.

18. An apparatus for collecting fluid from and disconnecting a drill string comprising, a plurality of frame members connected to form a rigid frame (120) defining generally planar vertically-oriented first and second sides (1000, 1004), said first side (1000) of said frame formed by connecting together a first set (1010, 1016, 1012, 1017) of said plurality of frame members into a first shape of a closed polygon (1020, 1021, 1022, 1023), said second side (1004) of said frame formed by connecting together a second set (1018, 1019, 1011, 1014) of said plurality of frame members into a second shape of a closed polygon (1024, 1027, 1028, 1029), first and second shells (201, 202) pivotally coupled to each other and designed and arranged to move from an open position around a joint (42, 43) coupling an upper pipe (40) of a predetermined diameter to a lower pipe (41) of said predetermined diameter to a closed position where said first shell (201) is mated with said second shell (202) and said first and second shells (201, 202) substantially form a bucket around said joint (42, 43), said first and second shells coupled to said frame (120), the range of motion of said first and second shells limited by said frame, and a spinner (47) coupled to said frame (120) and disposed longitudinally above said first and second shells, said spinner (47) designed and arranged for rotating said upper pipe (40) with respect to said lower pipe (41).

19. The apparatus of claim 18 further comprising, at least one actuator assembly coupled to said first and second shells and designed and arranged for moving said first and second shells from said open position to said closed position and vice versa.

20. The apparatus of claim 18 further comprising, a connection (46) fluidly coupled to said first shell (201) and designed and arranged for attachment to a hose.

21. The apparatus of claim 18 further comprising, a compliant gasket (45) coupled to said first and second shells (201, 202) designed and arranged to seal said first and second shells (201, 202) with respect to each other when said first and second shells (201, 202) are in said closed position.

22. The apparatus of claim 18 wherein said spinner (47) comprises, first and second rollers (48, 49) moveably and rotatably coupled to said frame (120) and designed and arranged to rotatively engage said upper pipe (40).

23. The apparatus of claim 18 wherein, said frame further defines generally planar horizontally-oriented top and bottom sides (1003, 1002), said bottom side (1002) disposed a first vertical distance below said first shell, said top side (1003) disposed a second vertical distance above said first shell.

24. The apparatus of claim 23 further comprising, first, second, third and fourth (1017, 1019, 1016, 1014) of said plurality of frame members each characterized by having a longitudinal axis and disposed so that its longitudinal axis is horizontal, said first frame member (1017) defining an upper edge (1023) of said first side (1000) and a first edge (1023) of said top side (1003), said second frame member (1019) defining an upper edge (1027) of said second side (1004) and a second edge (1027) of said top side (1003), said third frame member (1016) defining a lower edge (1021) of said first side (1000) and a first edge (1021) of said bottom side (1002), said fourth frame member (1014) defining a lower edge (1029) of said second side (1004) and a second edge (1029) of said bottom side (1002).

25. The apparatus of claim 18 wherein, each of said first and second sides of said frame extends vertically upward from a first horizontal datum plane at a first vertical distance below said first shell to a second horizontal datum plane disposed at a second vertical distance above said first shell.

26. The apparatus of claim 18 wherein, said first side is disposed so that a first imaginary line extends normally from a first plane defined by said first side and intersects said first shell, and said second side is disposed so that a second imaginary line extends normally from a second plane defined by said second side and intersects said first shell.

27. An apparatus for collecting fluid from a drill string comprising, first and second shells (201, 202), said first shell designed and arranged to be moved from an open position to a closed position with the first and second shells sealingly mating with each other around the circumference of a pipe of a predetermined diameter, and a plurality of frame members (1010, 1011, 1012, 1013, 1014, 1015, 1016, 1017, 1018, 1019, 1030, 1031, 1032) connected to form a rigid frame (120) that substantially surrounds said first and second shells, wherein said frame includes, first, second and third generally planar vertically-oriented sides (1000, 1001, 1004), said first and second shells confined between said first, second, and third sides of said frame, wherein said frame includes, first, second, third and fourth vertically oriented frame members (1010, 1012, 1013, 1011) each having a top end and a bottom end, a first horizontally oriented frame member (1016) connected between said bottom end of said first vertically oriented frame member (1010) and said bottom end of said second vertically oriented frame member (1012), a second horizontally oriented frame member (1015) connected between said bottom end of said second vertically oriented frame member (1012) and said bottom end of said third vertically oriented frame member (1013), a third horizontally oriented frame member (1014) connected between said bottom end of said third vertically oriented frame member (1013) and said bottom end of said fourth vertically oriented frame member (1011), a fourth horizontally oriented frame member (1017) connected between said top end of said first vertically oriented frame member (1010) and said top end of said second vertically oriented frame member (1012), a fifth horizontally oriented frame member (1018) connected between said top end of said second vertically oriented frame member (1012) and said top end of said third vertically oriented frame member (1013), a sixth horizontally oriented frame member (1019) connected between said top end of said third vertically oriented frame member (1013) and said top end of said fourth vertically oriented frame member (1011), a seventh frame member (1030) connected between said first vertically oriented frame member (1010) and said second vertically oriented frame member (1012), an eighth frame member (1031) connected between said second vertically oriented frame member (1012) and said third vertically oriented frame member (1013), and a ninth frame member (1032) connected between said third vertically oriented frame member (1013) and said fourth vertically oriented frame member (1011).

* * * * *